United States Patent [19]

Scalzitti et al.

[11] Patent Number: 4,984,516

[45] Date of Patent: Jan. 15, 1991

[54] APPARATUS FOR REMOVING FLUID FROM OVERLAPPING SHEETS OF MATERIAL

[76] Inventors: Attilio Scalzitti, 1258 Exeter Ct., Wheaton, Ill. 60187; Clarence A. Snyder, 3024 Whitepine Dr., Northbrook, Ill. 60062

[21] Appl. No.: 254,973

[22] Filed: Oct. 7, 1988

[51] Int. Cl.[5] ..... B30B 9/00; B30B 3/02

[52] U.S. Cl. ..... 100/90; 100/156; 100/210; 100/295; 414/907

[58] Field of Search ..... 100/90, 137, 210, 265, 100/266, 153, 156, 295, 144, 160, 155 R, 155 G; 414/907; 68/43, 22 R; 156/580, 312, 324

[56] References Cited

U.S. PATENT DOCUMENTS

| | | | |
|---|---|---|---|
| 588,125 | 8/1897 | Bundren | 100/156 |
| 3,798,933 | 3/1974 | Rotter | 100/172 X |
| 4,509,417 | 4/1985 | Brandt et al. | 100/156 X |
| 4,765,791 | 8/1988 | Brandt et al. | 100/156 X |
| 4,836,074 | 6/1989 | Mohr | 100/90 X |

FOREIGN PATENT DOCUMENTS

| | | | |
|---|---|---|---|
| 2723162 | 3/1987 | Fed. Rep. of Germany | 414/907 |

*Primary Examiner*—Harvey C. Hornsby
*Assistant Examiner*—Stephen F. Gerrity
*Attorney, Agent, or Firm*—John C. Brezina

[57] ABSTRACT

The present invention provides an improved apparatus particularly adapted for removing fluid from overlapping sheets of material, said apparatus comprising an inverted T-bar adapted for applying stationary pressure to overlapping sheets disposed beneath said T-bar, and at least two roller assemblies, said roller assemblies each including a lower pressure roller and an upper drive roller, said drive roller being in frictional contact with both said pressure roller and a superstrate positioned above said drive roller, at least one roller assembly being positioned on each side of said T-bar such that said pressure roller and said drive roller are substantially parallel thereto, and said roller assemblies being adapted to apply a moving pressure through said pressure rollers to overlapping sheets diposed beneath said roller assemblies.

13 Claims, 14 Drawing Sheets

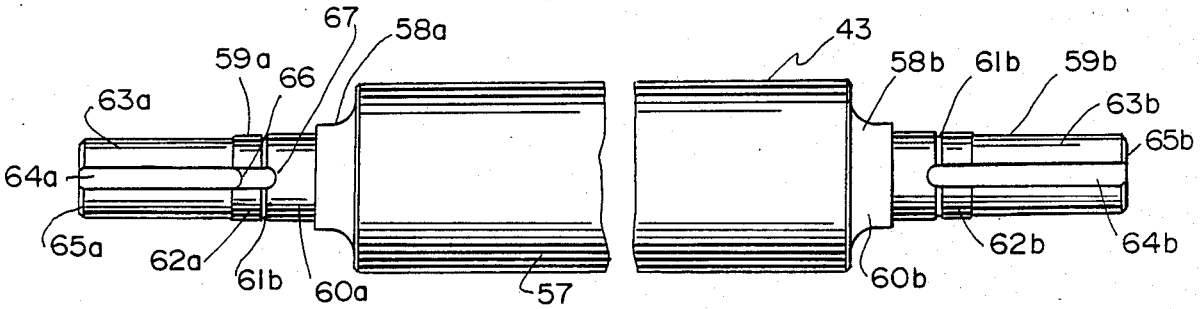
FIG.9
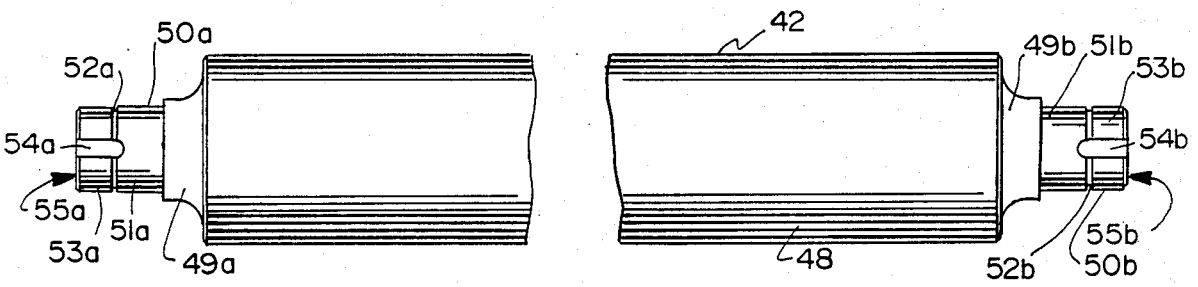
FIG.10
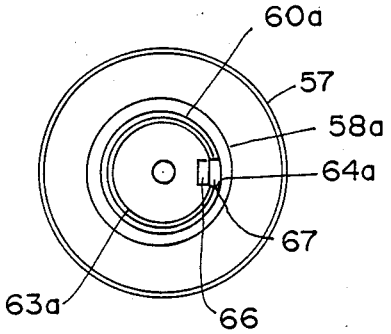
FIG.11
FIG.12
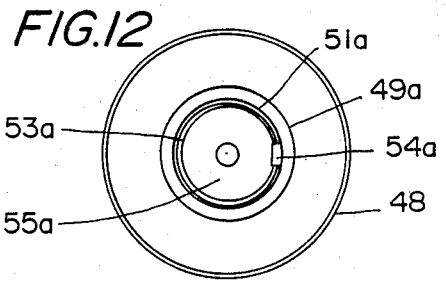
FIG.13
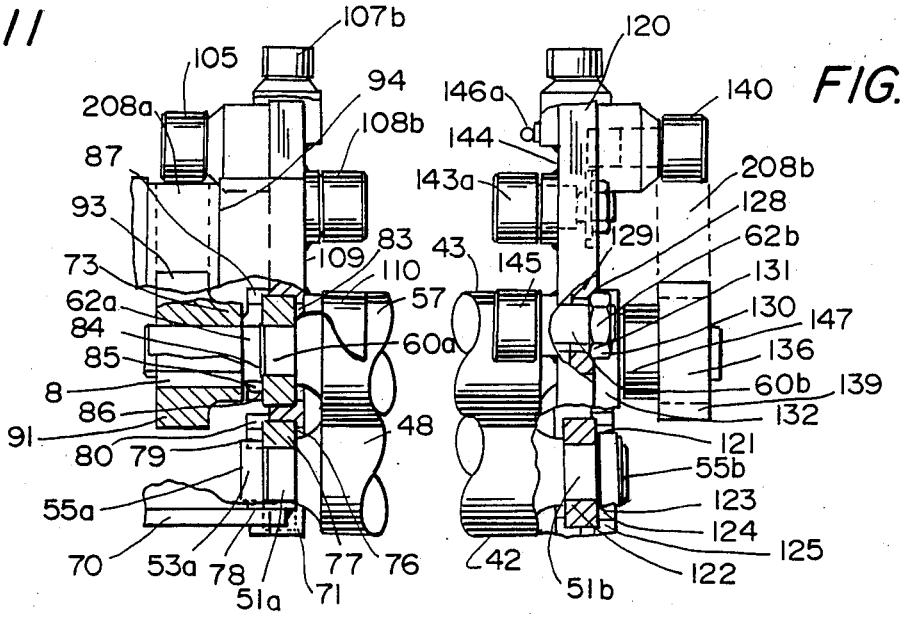

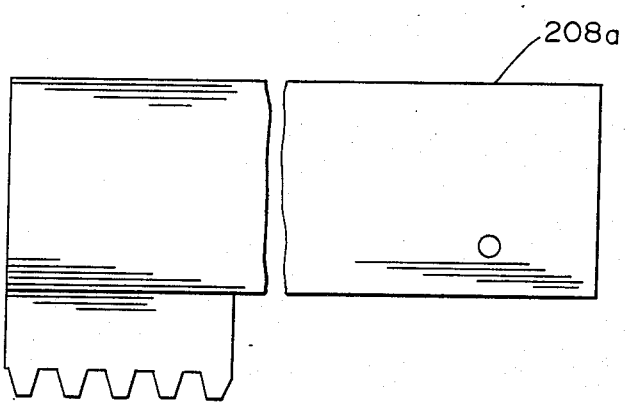
FIG.26
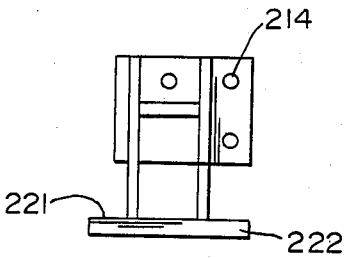
FIG.27A
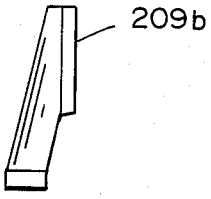
FIG.27B
FIG.31
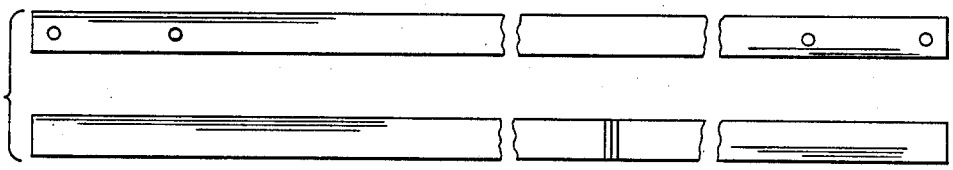

APPARATUS FOR REMOVING FLUID FROM OVERLAPPING SHEETS OF MATERIAL

BACKGROUND OF THE INVENTION

The present invention relates to machines for removing fluids from between overlapping sheets of material. The present invention relates in particular to removing air from stacks of paper sheets prior to subjecting the sheets to cutting operations.

In the production of many sheet-like products, including paper products, individual products are produced by first making a relatively large sheet, followed by cutting the sheet into individual products. For example, many paper products, such as letter bond, may be produced by making a relatively large sheet of bond paper, followed by cutting the bond into letter or legal-size sheets.

Copending application Ser. No. 07/255,142 (filed Oct. 7, 1988) by Attilio P. Scalzitti, entitled "Method and Apparatus for Removing Fluid from Overlapping Sheets of Material" is herein incorporated by reference.

Similarly, in the printing industry, different items commonly are printed on one large sheet of material in order to facilitate printing and handling. Such items may include brochures, stamps, and labels, for example. Although plastic, metal foil or a variety of other materials may be employed, most printing is performed using some type of cellulose-based material, such as paper, as the surface to which print is applied.

Labels are employed throughout the industrialized world to convey useful information, such as product identity, composition, quantity, source, directions for use and safety information. Products on which labels may be used include food stuffs, cleaning supplies, machine parts, medical supplies, and a plethora of other useful items. Typically, many labels are produced by printing a plurality of labels, often as many as 90, on one sheet of material, followed by cutting the labels apart and applying them individually to containers of products.

Materials such as ink and paper generally constitute a significant cost of the production of any printed matter. It is therefore desirable, when a plurality of items is printed on one sheet of material, that the items be printed as close to each other as possible in order to maximize the number of items on one sheet. It is also desirable to position the items on the sheet so that individual items may be cut apart using a few knife strokes as possible. These objectives are often accomplished by printing items on a sheet so that the edge of one item corresponds to the edge of another, so that the items may be severed by only one cut, without leaving superfluous material in between. However, this technique requires that the sheets be cut with a great deal of precision, such as in the printing of labels on the order of 1/64 inch, as inaccurate cuts outside of acceptable tolerances may cause the printed product to be rejected.

Further, although sheets may be cut individually, it is preferable that more than one sheet be cut at once in order to speed production and lower cost. For example, a typical label production run may involve the printing and cutting of more than 200,000 sheets. It is in part for this reason that identical sheets of labels typically are stacked one upon the other after printing so that multiple sheets may be cut simultaneously. However, in most printing operations this stacking is relatively crude, and the pages or sheets typically require further alignment before they can be properly cut. It is for this reason that sheets, after stacking, are often then passed to a "jogger".

Although a variety of jogging apparatus are known in the art, the typical jogger employs two adjacent edges, typically straight edges at a right angle to each other, and subjects the sheets to relatively abrupt, oscillating motion relative to the edges. This motion causes the sheets in the stack to shift position until they abut the edges, thereby causing the edges of the sheets in the stack to become aligned with each other. Often air is waved between the sheets in the stack during jogging, such as by manually waving or "winding" several sheets at a time, to lessen frictional contact between adjacent sheets and thereby facilitate the sheets shifting position.

Once the sheets have become aligned so that, within acceptable tolerances, items of the same dimensions printed on the sheets are aligned vertically in the stack, the stack is passed to a cutting machine where the stack comes in contact with a knife apparatus, and the individual items are severed from each other. Although it is often relatively easy to accurately cut the top few sheets in a stack, inaccuracies tend to develop as the knife passes through a stack, so that the sheets in the middle or bottom of the stack may be cut so inaccurately that they must be discarded.

Cutting inaccuracies may develop as a result of a variety of factors, such as knife dullness, loss of clamp pressure on the cutter, inadequate jogging, and uneven ink distribution on the sheets. One factor which contributes substantially to cutting inaccuracies is the presence of air or some other fluid between the sheets in a stack, as this usually lessens frictional contact between the sheets and permits them to shift position as the knife advances through the stack. Although inaccuracies in cutting are a problem in the production of many products, including non-printed products like legal or letter-size stationary paper, this problem is particularly acute where cutting of printed labels is concerned due to the fact that many labels may be printed on a single sheet and must be cut with a relatively high degree of accuracy.

At least two techniques have been employed in the printing industry to remove air from between pages in a stack. One such means is a jogger equipped with a roller, wherein the roller passes over the surface of the stack during or after alignment of the sheets. Another device, disclosed by U.S. Pat. No. 4,509,417, FIG. 3., removes air from between sheets in a stack by grasping one end of the stack and pulling the stack through the nip between two rollers.

Although these means may be adequate for some operations wherein a great deal of cutting precision is not required, these methods and equipment for fluid removal may be inadequate for the production of certain products, especially such as labels, brochures and other printed matter, wherein it is imperative that shifting of position of the sheets during cutting be kept to a minimum. As a result, an apparatus and method which effectively remove fluid such as air from overlapping sheets of material so that shifting of sheets during cutting is minimized may offer significant practical advantages over apparatus and methods known in the art.

SUMMARY OF THE INVENTION

The present invention is directed to apparatus which are particularly adapted for removing fluid from between overlapping sheets of material disposed on a substrate. This apparatus comprises an inverted T-bar adapted for applying stationary pressure to overlapping sheets disposed beneath said T-bar, and at least two roller assemblies, said roller assemblies each including a lower pressure roller and an upper drive roller, said drive roller being in frictional contact with both said pressure roller and a superstrate positioned above said drive roller, at least one roller assembly being positioned on each side of said T-bar such that said pressure roller and said drive roller are substantially parallel thereto, and said roller assemblies being adapted to apply a moving pressure through said pressure rollers to overlapping sheets disposed beneath said roller assemblies.

BRIEF DESCRIPTION OF THE DRAWINGS

FIG. 9 is a side view of the drive roller of FIG. 1.

FIG. 10 is a side view of the pressure roller of FIG. 1.

FIG. 11 is an end view, taken from the left, of the drive roller of FIG. 9.

FIG. 12 is an end view, taken from the left, of the pressure roller of FIG. 10.

FIG. 13 is a partial side view, partially broken away, of the right roller unit of FIG. 1 taken from the right.

FIG. 26 is a partial front view of front lateral gear rack 208(*a*) of FIG. 3.

FIG. 27A is a front view of right front mounting bracket 209(*b*) of FIG. 3.

FIG. 27B is a side view, taken from the right, of the bracket of FIG. 27A.

FIG. 31 is a front view of front lateral gear rack 208(*a*) of FIG. 3.

DETAILED DESCRIPTION OF THE INVENTION

The present invention is an improved apparatus and method particularly adapted for removing fluids from between overlapping sheets of material.

The present invention may be useful for removing a variety of liquids such as water, oils and organic solvents from between overlapping sheets. However, the present invention may be particularly useful when the fluid is a gas such as carbon dioxide, nitrogen or a gaseous mixture such as air. Similarly, the present invention may be used to remove fluid from between sheets of a variety of different relatively thin, sheet-like materials, such as plastic films such as polystyreneacrylonitrile (SAN), polyethylene or polypropylene films, metal foil, paper, and various composite materials. However, the invention may be particularly useful for removing air from between overlapping sheets of paper.

By "overlapping" is meant that at least part of one sheet is disposed or "stacked" on another so that broad surfaces are adjacent. Although it is usually preferred that the edges of overlapping sheets be as even as practicably possible to enhance the cost effectiveness of producing certain products such as labels, the present invention does not require that the edges be even in order to be operational.

The apparatus of the present invention includes means for applying stationary pressure to overlapping sheets and means for applying transient pressure to the sheets. By "stationary" is meant that the stationary pressure means is adapted to apply pressure to an area of the sheets, and that the area of the sheets to which pressure is applied remains substantially the same throughout application of the pressure. In contrast, "transient" pressure may initially be applied to one area of the sheets, but moves to another area of the sheets before the application of pressure is terminated. Although the magnitude of the stationary and/or the transient pressure may vary while pressure is being applied, it is preferred that the apparatus be adapted so that, between initiation and termination of the application of stationary pressure and transient pressure, respectively, the magnitude of the pressure remains substantially the same, such as a stationary pressure of ± about 50 to about 300 ft. lb./sq. in. and a transient pressure ± of about 50 to about 300 ft. lb./sq. in. Transient and stationary pressures of about 200 to about 250 ft. lb./sq. in. are preferred. Usually adequate transient and stationary pressure may be applied by merely permitting the apparatus to rest on top of the stack, or by applying additional pressure by forcing the apparatus down on the stack, as described below.

Figure 1:
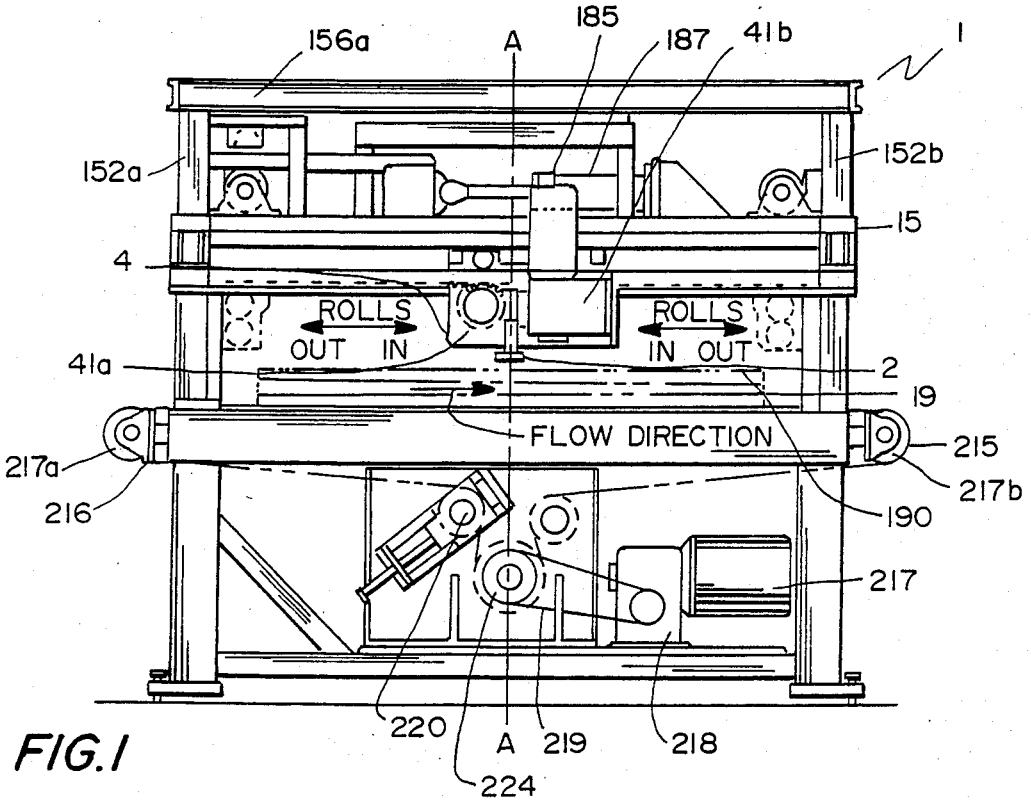
FIG. 1 is a front view of the preferred embodiment of the apparatus of the invention.

Referring now to FIG. 1, in the preferred embodiment, the stationary pressure means is incorporated into apparatus 1 in the form of T-bar assembly 2, and the transient pressure means is incorporated into apparatus 1 in the form of roller assembly 4. Stationary and transient pressure typically are applied by contact of T-bar assembly 2 and roller assembly 4 of apparatus 1 with the top surface 190 of a stack 19 of a plurality of sheets of material.

Figure 6:
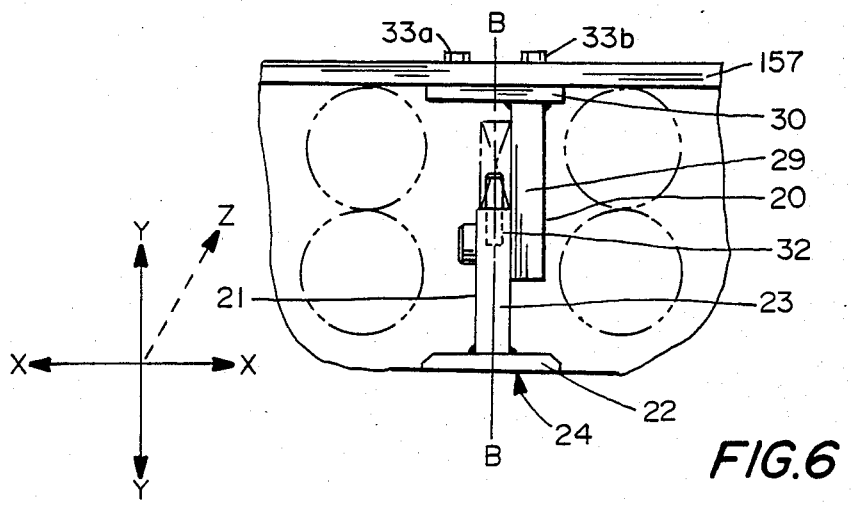
FIG. 6 is a front view of the T-bar assembly of FIG. 1.

Referring to FIG. 6, T-bar assembly 2 generally has a double "T" configuration and includes right-side-up T-bar 20 and inverted T-bar 21. Elongate T-bar 21 is as long or longer than the dimension of the stack to which it is applied in order to avoid marking the top sheets in the stack. By "elongate" is meant that T-bar 21 has one dimension which is larger than the other two dimensions, such as shown in FIG. 7.

Referring to FIG. 6, T-bar 21 preferably has a generally inverted "T" configuration, with foot 22 attached to and being wider (along the "X" axis) than inverted T-stem 23. Foot 22 preferably has a relatively smooth, planar bottom surface 24 for even contact with the top surface 190 of stack 19 in FIG. 1. Inverted T-stem 23 is preferably as long as foot 22, and is higher (along the "Y" axis) than it is wide. Referring to FIG. 7, inverted T-stem 23 is pierced periodically along its length by holes 25(*a*), (*b*), (*c*) which permit the introduction therethrough of shoulder bolts 26(*a*), (*b*), (*c*). Washers 27(*a*), (*b*), (*c*) are slid onto bolts 26(*a*), (*b*), (*c*) between the head 28(*a*), (*b*), (*c*) of the shoulder bolts and inverted stem 23. Shoulder bolts 26(*a*), (*b*), (*c*) are attached to stationary plate 29, thereby providing a sliding attachment between inverted T-bar 21 and stationary plate 29. Stationary plate 29 is of a relatively narrow, (along the "X" axis), elongate (along the "Z" axis) configuration, preferably approximately as long as inverted T-bar 21, and is taller (along the "Y" axis) than it is wide. Referring to FIG. 6, stationary plate 29 is attached at its top end to upper T-plate 30 by means of welds 31. Stationary plate 29 is attached to upper T-plate 30 so as to be off-center, as that axis B—B approximately bisects upper T-plate 30, inverted T-stem 23 and foot 22. Upper T-plate 30 is attached to platform bottom plate 157 of platen assembly 15 by conventional means such as a plurality of bolts along plate 30's length, such as bolts 33(*a*), (*b*).

Figure 7:
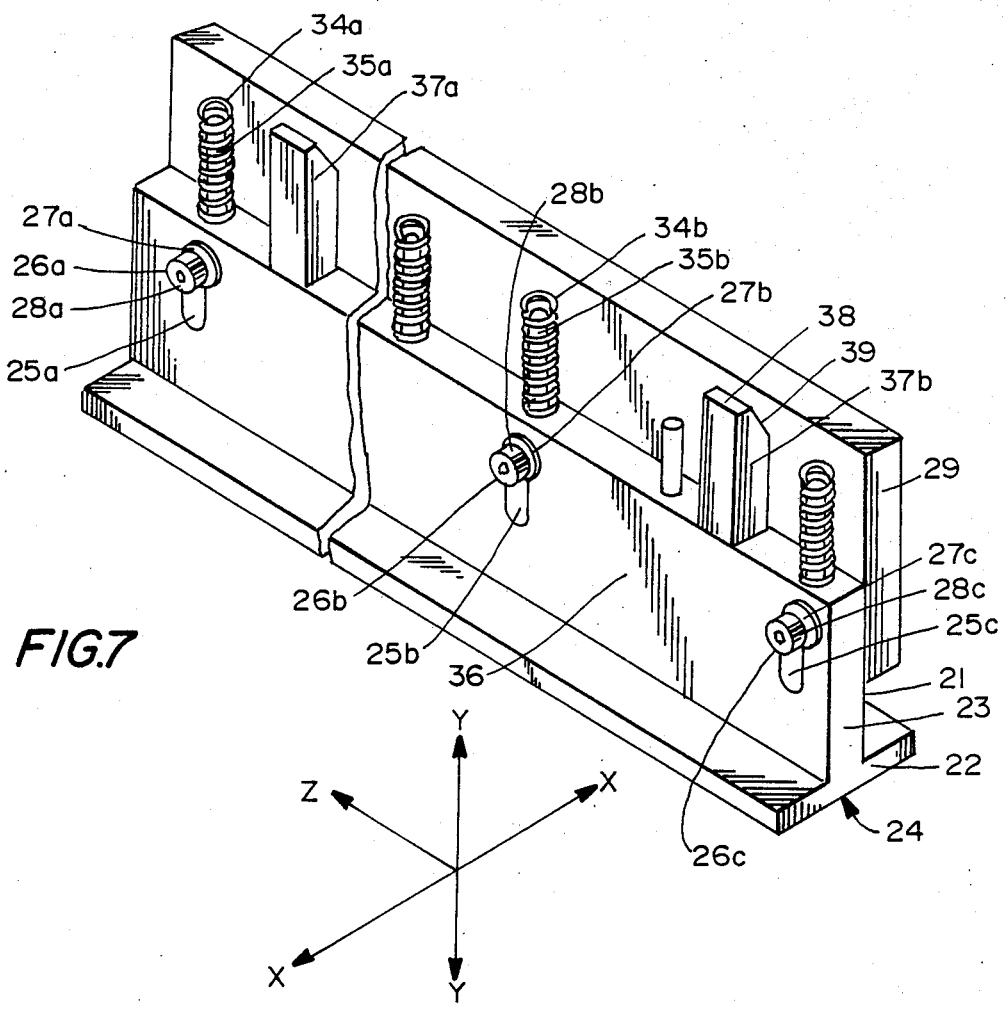
FIG. 7 is a partial perspective view of the T-bar assembly of FIG. 6, without upper T-bar and weld.

Referring to FIG. 7, springs 34(*a*), (*b*) fit relatively loosely over a plurality of preferably cylindrical posts 35(*a*), (*b*) which are attached to the top of stem 23 by conventional means such as being slip fitted into a hole (32, FIG. 6) and secured by means such as set screws 36. (Set screws are preferably used to attach the pegs, although the screws may be hidden from view by washers such as 27(*a*).) Springs 34(*a*), (*b*) are such that they are capable of carrying a substantial load without fully compressing, such as 1000 lb. commercially available die springs.

A plurality of stops 37(*a*), (*b*) are also attached, such as by welding, to the top of inverted T-stem 23. Stops 37(*a*), (*b*) are generally rectangular blocks, such as 1 inch square blocks, having a relatively flat top area 38, with the portion 39 of the top of the stop near stationary plate 29 being cut away so that the portion 39 and stationary plate 29 form an acute angle in order to clear weld 31 at the top stationary plate 29 when T-bar assembly 2 is fully compressed. The size of stops is selected so that when attached to the top of inverted stem 23, stops 37(*a*), (*b*) are slightly taller than posts 35(*a*), (*b*), such as in the preferred embodiment on the order of ⅛ inch or taller, and preferably at least ¼ inch or taller.

In operation, stationary pressure is applied to stack 19 by lowering T-bar assembly 2 so that bottom surface 24 of foot 22 contacts the surface 190 of stack 19. As T-bar assembly 2 is further lowered more pressure is applied, causing shoulder bolts 26(*a*), (*b*), (*c*) to move downward in holes 25(*a*), (*b*), (*c*). Springs 34(*a*), (*b*) come in contact with the bottom of upper T-plate 30 and are compressed under the applied load. If sufficient pressure is applied such as where roller assembly 4 moves off the edge of the stack, causing platform 15 of platen assembly 15 to exert further force on springs 34(*a*), (*b*), stops 37(*a*), (*b*) contact the bottom surface of upper T-plate 30 and prevent damage to posts 35(*a*), (*b*), springs 34(*a*), (*b*) and shoulder bolts 26(*a*), (*b*), (*c*).

Referring to FIG. 1, roller assembly 4 preferably comprises a matched pair of roller assemblies such as left roller unit 41(*a*) and right roller unit 41(*b*) positioned on opposite sides of T-bar assembly 2. Referring now to FIGS. 8–16, the structure of said roller units is more particularly described with reference to right roller unit 41(*b*), with left roller unit 41(*a*) having the same structure as roller unit 41(*b*), with the exception that left roller unit 41(*a*) is rotated 180 degrees in a plane perpendicular to the "Y" axis, and is affixed to platform bottom plate 157 of platen assembly 15 on the opposite side of T-bar assembly 2 from right roller unit 41(*b*).

Figure 8:
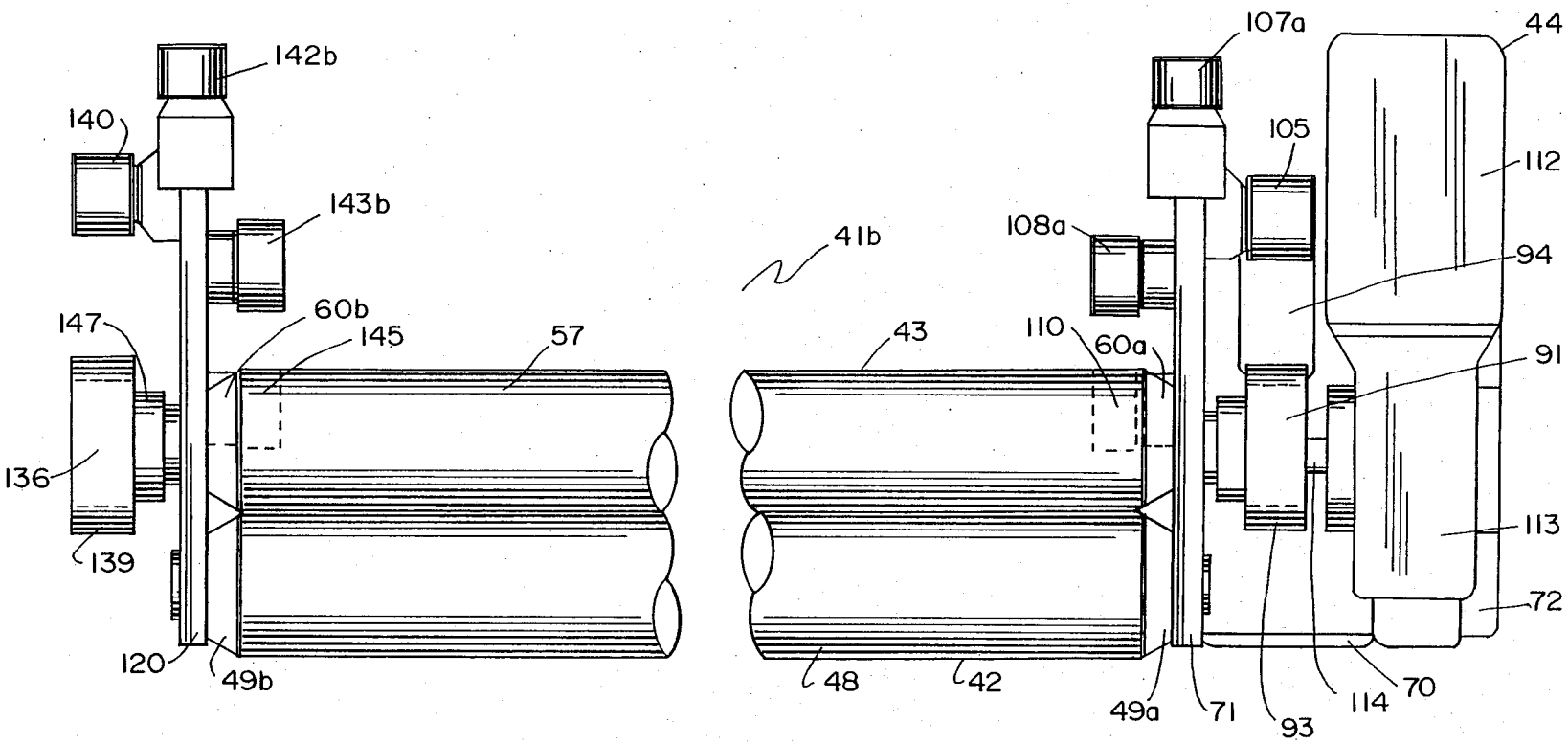
FIG. 8 is a side view, taken from the left of axis A—A, of the right roller unit of FIG. 1.

Referring to FIG. 8, roller unit 41(*b*) includes pressure roller 42, drive roller 43, drive roller drive gear 91, idle gear 136 and motor unit 44. Referring to FIG. 10 pressure roller 42 is a solid, one piece elongate, cylindrical roller having a central right cylindrical portion 48 which is longer than the dimension of stack 19 to which pressure roller 42 is applied to prevent marking the top few sheets in the stack. A central cylindrical portion of about 3½ inches in diameter will be preferred for most applications, although larger or smaller rollers may be used consistent with the invention. Central cylindrical portion 48 terminates in chamfered shoulders 49(*a*) (*b*), as square shoulders may exhibit an increased tendency to crack under the stress of use. Shoulders 49(*a*) (*b*) taper to a narrower diameter than central cylindrical portion 48, for most applications preferably about 1⅞ inch. Roller ends 50(*a*) (*b*) include a relatively smooth, right cylindrical bearing journal portion 51(*a*) (*b*) next to shoulders 50(*a*) (*b*), respectively, which is adapted to fit through holes 76 and 121 of drive unit end plate 71 and idle bracket end plate 120, respectively, shown in FIG. 13. Bearing journal 51(*a*) (*b*) preferably is about 1.57 inches in diameter and about 0.88 inches long, although other dimensions may be used consistent with the invention. Journal 51(*a*) (*b*) ends in groove 52(*a*) (*b*), which facilitates the machining of threads. Groove 52(*a*) (*b*) encircles roller 42 and preferably indents to a diameter of about 1.47 inch, and preferably has a width of about 0.09 inch. Threaded portion (preferably with 18 threads/inch) 53(*a*) (*b*) is on the side of groove 52(*a*) (*b*), respectively, distal to central cylindrical portion 48, and is preferably about 1.57 inches in diameter and about 0.53 inches long. Key way 54(*a*) (*b*) is cut into the margin of roller ends 50(*a*) (*b*) respectively, and preferably extends along the margin from end face 55(*a*) (*b*), respectively, toward the center of roller 42 for about 0.88 inches, and is about 0.31 inches wide and is adapted to receive a ball bearing lock washer, with lock washer tab shown at 56 in FIG. 13. A bell center, not shown, preferably is cut into end faces 55(*a*) (*b*) to facilitate fabrication of pressure roller 42. As is apparent from the drawings, central cylindrical portion 48, shoulders 49(*a*), (*b*), journal 51(*a*), (*b*), groove 52(*a*), (*b*), and threaded portions 53(*a*) (*b*) are concentric.

Referring to FIG. 9, the structure and preferred dimensions of drive roller 43 are similar to that of pressure roller 42. Drive roller central cylindrical portion 57 is at least as long as pressure roller cylindrical portion 48. Drive roller 43 includes chamfered and tapered shoulders 58(*a*) (*b*), which terminate in drive roller ends 59(*a*) (*b*), respectively. Bearing journal portion 60(*a*) (*b*) of ends 59(*a*) (*b*) next to shoulders 58(*a*) (*b*) are adapted to fit through hole 83 in drive unit end plate 71 and hole 128 in idle unit end plate 120, respectively. Threaded portion 62(*a*) (*b*) is on the distal side of groove 61(*a*) (*b*) from journal 60(*a*) (*b*) and central cylindrical portion 57. Unlike pressure roller 42, however, ends 59(*a*) (*b*) extend from threaded portion 62(*a*) (*b*) to form a right cylindrical portion 63(*a*) (*b*), which is adapted for engagement with drive gear 91 and idle gear 136, respectively. Drive end 63(*a*) and idle end 63(*b*) preferably are about 1.47 inches in diameter and about 2.88 inches long. Stepped key way 64(*a*) (*b*) extends along the margin of ends 59(*a*) (*b*) from end face 65(*a*) (*b*), respectively, and is adapted to receive a key and a lock washer tab. A part of key way 64(*a*) (*b*) extends only as far as slightly into threaded portion 62(*a*) (*b*), as shown at end 66 with respect to 62(*a*) in FIG. 9, and receives key 68 shown in FIG. 13, while a part of key way 64(*a*) (*b*) extends slightly into portion 60(*a*) (*b*), as shown at end 67, and receives the tab of lock washer 86 shown in FIG. 13. In the preferred embodiment the key ways 64(*a*) (*b*) extend from end face about 3 inches to the end, such as 66, in threaded portions 62(*a*) (*b*), and an additional 0.5 inches to the end, such as 67, in portion 60(*a*). A bell center (not shown) preferably is cut into end faces 65(*a*) (*b*) to facilitate fabrication of drive roller 43. As is readily apparent, central cylindrical portion 57, shoulders 58(*a*) (*b*), journal 60(*a*) (*b*), groove 61(*a*) (*b*), threaded portion 62(*a*) (*b*), drive end 63(*a*) and idle end 63(*b*) are concentric.

Drive roller 43 and pressure roller 42 are preferably constructed from metal. It is preferred however, that the drive roller 43 and pressure roller 42 be composed of different metals, such as where the pressure roller is made of steel and the drive roller of stainless steel, in order to minimize galling. Steels such as (SAE) 1045 steel and stainless steels such as (SAE) 17-4 PH stainless steel are most preferred.

Figure 14:
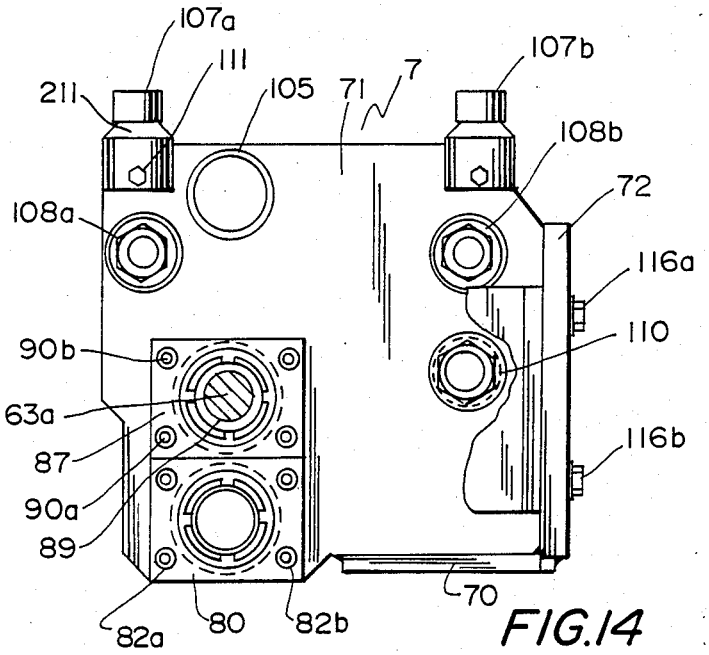
FIG. 14 is an end view taken from the front, of the drive unit end plate of the right roller unit of FIG. 1.

Pressure roller 42 and drive roller 43 are attached on one end to drive unit 7 and to idle unit 12 at the other. Referring to FIG. 14, drive unit includes drive unit end plate 71, drive unit side plate 72 attached to end plate 71, and 45 degree drive unit gusset 70, attached to end plate 71 and side plate 72. End plate 71, side plate 72, and gusset 70 are attached together to 70 by conventional means such as welding.

Referring to FIG. 13, journal portion 51(*a*) of pressure roller 42 fits through hole 76 in end plate 71. Fitted within hole 76 are self-aligning bearings 77. Pressure roller 42 is retained within hole 76 in rolling contact with bearings 77 by means lock nut 78 and lock nut washer 79 threaded and locked onto threaded portion 53(*a*) of pressure roller 42 by bending a lock washer tab to fit into key way 54(*a*). Pressure roller bearing cap 80 covers hole 76, bearings 77 and pressure roller end face 55(*a*) so as to retain bearings 77 within hole 76. Referring to FIG. 14, pressure roller bearing cap 80 is fastened to end plate 71 on the side distal to pressure roller central portion 48 by conventional means such as bolts 82(*a*) (*b*).

Similarly, referring to FIG. 13, journal 60(*a*) of drive roller 43 fits through hole 83 in end plate 71 and is in rolling contact with self-aligning bearings 84 in hole 83. Roller 43 is retained within hole 83 by means of lock nut 85 and lock washer 86 threaded and locked onto threaded portion 62(*a*) of drive roller 43 by bending a lock washer top into key way 64(*a*) at 67. Drive roller bearing cap 87 covers hole 83 in end plate 71 and bearings 84 so as to retain bearings 84 in hole 83. In addition, drive roller bearing cap 87 has a central opening 89 sufficient to permit extension of drive end 63(*a*) through bearing cap 87, as shown in FIG. 14. Bearing cap 87 is fastened to end plate 71 on the side distal to drive roller central portion 57 by conventional means such as bolts 90(*a*) (*b*). Drive gear 91 is fitted concentrically around drive end 63(*a*) of drive roller 43, and is affixed thereto by means of introduction of key 68 in key way 64(*a*) of drive roller 43 and key way 92 of drive gear 71, and by set screws introduced thru gear hub 73 and engaged with matching indentations on the roller, as is known in the art. Teeth 93 on drive gear 91 match and engage teeth on lateral gear rack 208(*a*) which fits through cut away 94 in side plate 72 of drive housing 70. Roller drive gear 91 is generally larger in diameter than the drive gear mounted on the electric motor reducer output shaft. The diameter of roller drive gear 91 is selected so that the pitch diameter-that is, the center line of rotation between roller drive gear 91 and the reducer drive gear, is approximately equal to the diameter of drive roller central cylindrical portion 57 in order to minimize skidding of roller 43 during operation.

Figure 5:
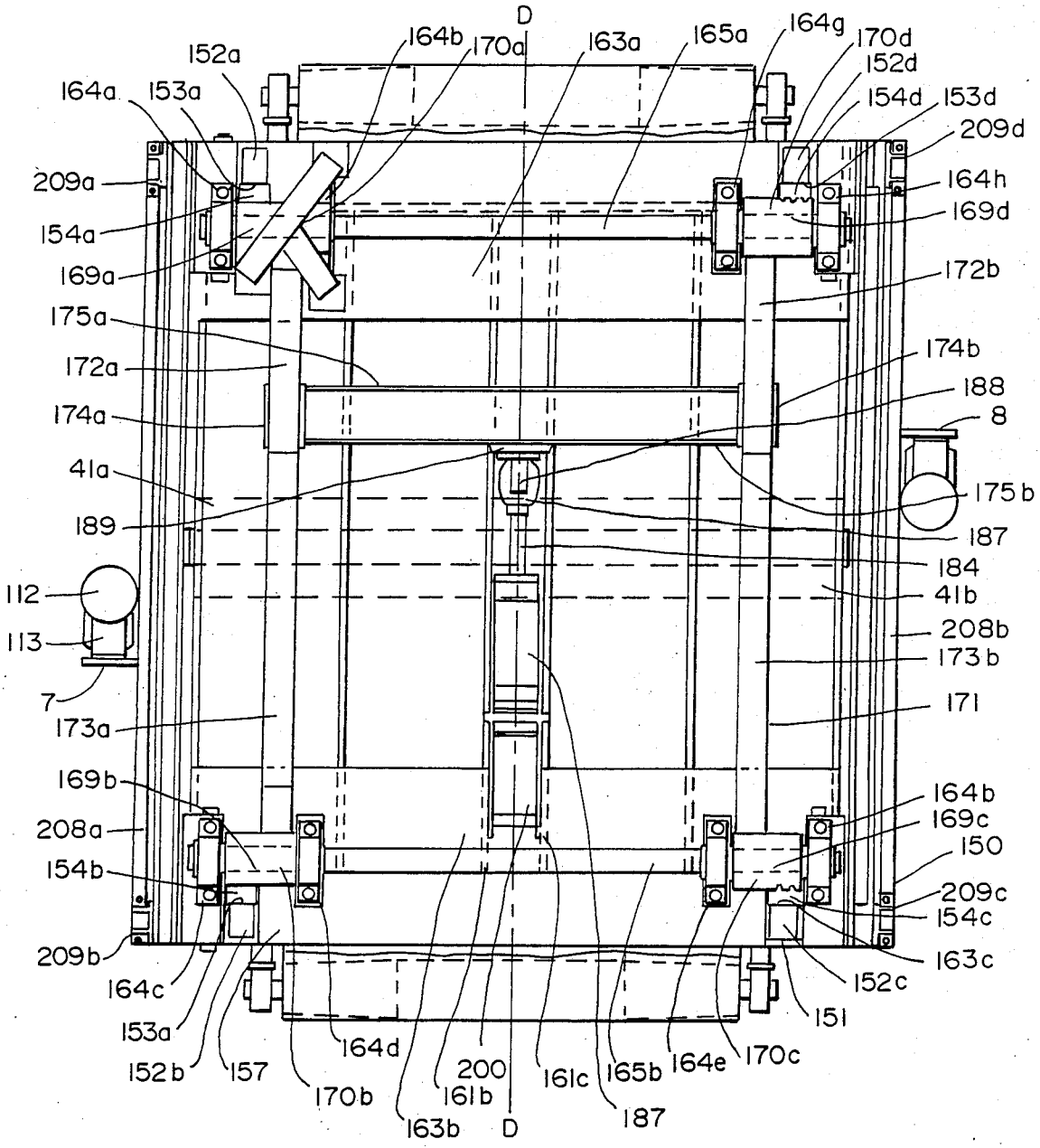
FIG. 5 is a top view of the apparatus of FIG. 1.

Referring to FIG. 5, motor unit 44 includes generally a C-phalange mounted electric motor 112, a gear reducer 113, an output shaft 114, and a drive gear 115. Electric motor 112 is not critical to the invention, but may be any of a variety of standard electric motors known in the art. Electric motor 112 is mounted on top of gear reducer 113 (also a standard item), which is attached to side plate 72 (see FIG. 16) by a plurality of bolts 116 (*a*) (*b*). Electric motor output shaft 114 extends from gear reducer 113 toward drive unit end plate 72. Motor drive gear 115 is mounted on output shaft 114 by means of key 117 in key way 118 of shaft 114 and key way 119 of drive gear 115, and set screws in the hub of drive gear 115. Motor drive gear 115 is generally smaller than roller drive gear 91. Motor unit 44 is configured such that motor drive gear is next to and to the outside of roller drive gear 91. In operation, electric motor 112 imparts motion to gear reducer 113, which causes output shaft 114 and motor drive gear 115 to rotate. Gear teeth on motor drive gear 115 engage matching teeth 93 on roller drive gear 91, causing roller drive gear 91 to rotate. Roller drive gear teeth 93 also engage matching teeth on front lateral gear rack 208 (*a*), causing drive unit 7 to move or "walk" laterally along lateral rack 208 (*a*).

Except for not connecting with a motor unit, the structure of idle unit 12 is analogous to that of drive unit 7.

Referring to FIG. 13, journal 51 (*b*) of pressure roller 42 fits through hole 121 in end plate 120 of idle unit 12. Fitted within hole 121 are self-aligning bearings 122. Pressure roller 42 is retained within hole 121 in rolling contact with bearings 122 by means lock nut 123 and lock nut washer 124 threaded and locked onto portion 53 (*b*) of pressure roller 42 by folding a lock nut washer tab from washer 124 into key way 54 (*b*). Pressure roller bearing cap 125 covers hole 121, bearings 122 and pressure roller end face 55 (*b*) so as to retain bearings 122 within hole 121, and is fastened to end plate 120 on the side distal to pressure roller central portion 48 by conventional means such as bolts 127 (*a*) (*b*). (See FIG. 15).

Figure 15:
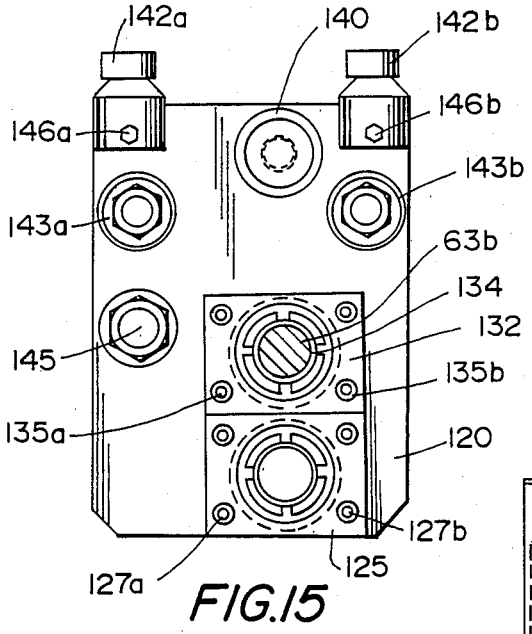
FIG. 15 is an end view, taken from the rear, of the idle unit end plate of FIG. 1.

Similarly referring to FIG. 13, journal 60 (*b*) of drive roller 43 fits through hole 128 in end plate 120 and is in rolling contact with self-aligning bearings 129 in hole 128. Roller 43 is retained within hole 128 by means of lock nut 130 and lock washer 131 threaded and locked onto portion 62 (*b*) of drive roller 43. Referring to FIG. 15, drive roller bearing cap 132 covers hole 128 in end plate 120 and bearings 129 so as to retain bearings 129 in hole 128. In addition, drive roller bearing cap 132 has a central opening 134 sufficient to permit extension of idle end 63 (*b*) through bearing cap 132. Bearing cap 132 is fastened to end plate 120 on the side distal to drive roller central portion 57 by conventional means such as bolts 135 (*a*) (*b*). Referring to FIG. 13, idle gear 136 is fitted concentrically around idle end 63 (*b*) of drive roller 43, and is affixed thereto by means of introduction of key 137 (not shown) in key way 64 (*b*) of drive roller 43 and key way 138 of idle gear 136 and by means of set screws in idle gear hub 147, in the same manner that drive gear 91 is affixed to drive end 63 (*a*). Teeth 139 on idle gear 136 match and engage teeth on rear lateral gear rack 208 (*b*). Drive roller holes 83 and 128 in drive unit end plate 71 and idle unit end plate 120, drive roller bearings 84 and 129, as well as the other components of drive unit 7 and idle unit 12 are constructed and configured such that when assembled, drive roller central cylindrical portion 57 is in frictional contact with both the underside of platform bottom plate 157 of platen assembly 15 and pressure roller central cylindrical portion 48.

Left roller unit 41 (*a*) and right roller unit 41 (*b*) are attached to platen assembly 15 by means of upper and lower platform guide rollers mounted on drive unit 7 and idle unit 12 and in rolling contact with bottom plate guide track 210 and the underside of bottom plate 157, respectively. When roller assembly 4 is in contact with a substrate and pressure is being applied, such as during rolling operations, the rack rollers serve to help hold down back and front lateral gear racks 208 (*b*) and (*a*). During operation, roller units 41 (*a*) (*b*) are further guided back and forth along lateral gear rack 208 (*a*) (*b*) by means of additional rollers attached to drive unit 7 and idle unit 12. These rack and guide rollers are hereinafter described with reference to right roller unit 41 (*b*), including drive unit 7 and idle unit 12 shown in FIGS. 8–16. However, the same rack and guide rollers exist is left roller unit 41 (*a*).

Figure 16:
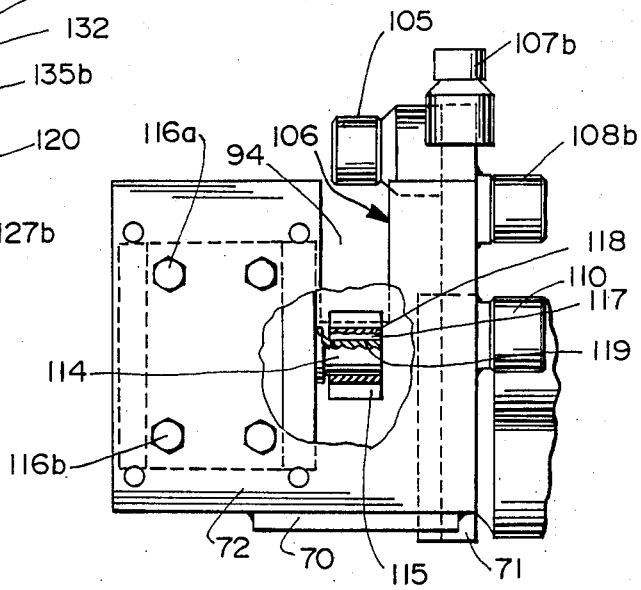
FIG. 16 is a partial side view, partially broken away and showing the motor unit drive gear, of the drive unit of the right roller unit of FIG. 1.

Referring to FIGS. 13 and 16, front lateral gear rack 208 (*a*) fits through cut out 94 in drive unit end plate 71. Drive unit rack roller 105 is attached to the upper part of outer face 106 of drive unit end plate 71. Rack roller 105 is attached to outer face 106 so as to overhang and be in rolling contact with the top of front lateral rack 208 (*a*) when lateral rack 208 (*a*) is in cut out 94. Similarly, idle unit 12 is suspended from rear lateral gear rack 208 (*b*) by means of rack roller 140. (See FIGS. 13, 14). Rack roller 140 is attached to the upper part of outer face 141 of idle unit end plate 120 so as to overhang and be in rolling contact with the top of rear lateral rack 208 (*b*). (Conversely, for left roller unit 41 (*a*), the idle unit rack roller will be in rolling contact with the top of front lateral gear rack 208 (*a*) and the drive unit rack roller will be in rolling contact with the top of rear lateral gear rack 208 (*b*). Rack rollers 105, 140 serve to hold down front and rear lateral gear racks 208 (*a*) (*b*), respectively, so that mechanical contact is maintained between gear racks 208 (*a*) (*b*) and drive and idle gears 91, 136, respectively, on drive roller 43.

Drive unit 7 is guided back and forth along front lateral gear rack 208 (*a*) by means of a plurality of guide rollers. These include track guide rollers 107 (*a*) (*b*) attached to the top margin of drive unit end plate 71, generally at a right angle to rack roller 105, and fit into and are in rolling contact with track 205 (*a*) of front frame plate 158 (*a*) of platform 150. A pair of upper platform guide rollers 108 (*a*) (*b*) are attached to drive unit end plate inner face 109, generally parallel to rack roller 105 and at a right angle to track guide rollers 107 (*a*) (*b*). Upper platform guide rollers 108 (*a*) (*b*) overhang and are in rolling contact with bottom plate front guide track 210 (*a*) attached to front edge of the top face of bottom plate 157 of platform 150. Guide rollers 108 (*a*) (*b*) suspend drive unit 7 from bottom plate 157 when platen 15 is in an "up" position, and assist in guiding drive unit 7 along front lateral rack 208 (*a*) and platform 150. Lower platform guide roller 110 is approximately parallel to upper platform guide rollers 108 (*a*) (*b*) and is attached to end plate inner face 109 so as to fit underneath and be in rolling contact with the under surface of the front edge of bottom plate 157. Rollers 105, 107 (*a*) (*b*), 108 (*a*) (*b*) and 110 are attached to end plate 71 by conventional means such as threading onto screws, such as screw 211 attaching roller 107 (*a*) to drive unit end plate 71 (FIG. 14), and may include grease fittings such as 111 (*a*) (*b*).

Idle unit 12 includes guide rollers analogous to those of drive unit 7. Referring to FIG. 15, idle unit 12 includes track guide rollers 142 (*a*) (*b*) attached to the top margin of idle unit end plate 120 at a right angle to rack roller 140 and in rolling contact with track 208 (*b*) of rear frame plate 158 (*c*). Upper platform guide rollers 143 (*a*) (*b*) attached to idle unit end plate 120 inner face 144 (see also FIG. 15) and are in rolling contact with bottom plate rear guide track 210 (*b*) attached to the rear edge of the top face of bottom plate 157. Lower platform guide roller 145 is attached to end plate inner face 144 and is in rolling contact with the bottom face of the rear edge of bottom plate 157. Rollers 140, 142 (*a*) (*b*), 143 (*a*) (*b*) and 145 are attached to end plate 120 by conventional means such as screws, and may include grease fittings such as 146 (*a*) (*b*).

The rack and guide rollers discussed above are cam followers which are readily available from commerical sources in assembled form, ready for attachment to other devices such as end plates 71

Figure 2:
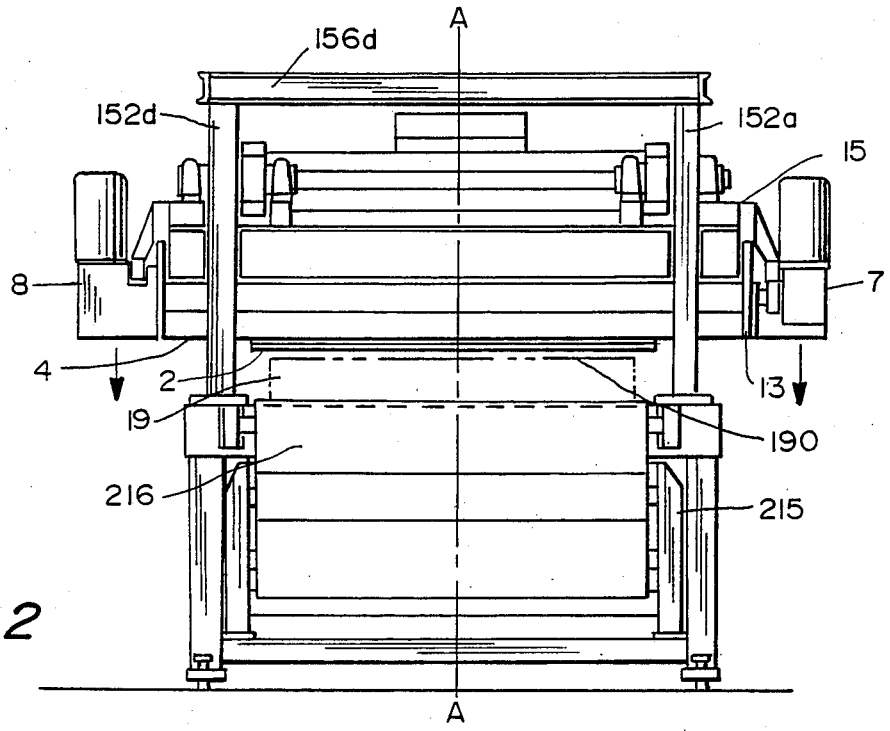
FIG. 2 is a view of the apparatus of FIG. 1 rotated to the left 90° along the axis A—A.

Referring to FIGS. 1 and 2, T-bar assembly 2 and roller assembly 4, including right and left drive units 7, 8, respectively, and right and left idle units 12, 13, respectively, are raised and lowered to break and make contact between bottom surface 24 of T-bar assembly 2, the pressure rollers of left and right roller units 41 (*a*) (*b*) and top surface 190 of stack 19. This raising and lowering preferably is accomplished by attaching T-bar assembly and roller assembly 4 to the bottom of a platen. Platens are well known in the art as being platforms which are adapted to be moved up and down to apply pressure to something. The structure of the platen to which the T-bar assembly and roller assembly are attached is not critical to the invention, but may be any of a variety of plant structures known in the art. However, the preferred platen is one which shows increased stability over many platens known in the art.

Figure 3:
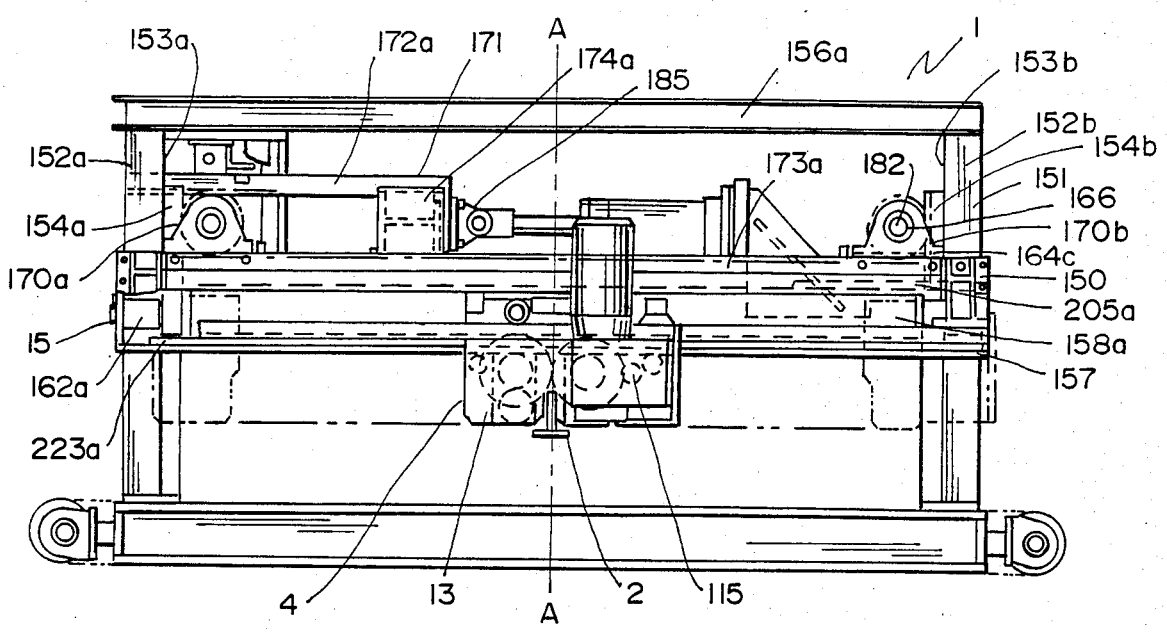
FIG. 3 is a drawing, partially broken away of the apparatus as shown in FIG. 1, except that the front lateral rack and the left roller drive gear depict a less preferred embodiment wherein the pitch diameter of the rack and drive gear is larger than the drive roller diameter.
Figure 4:
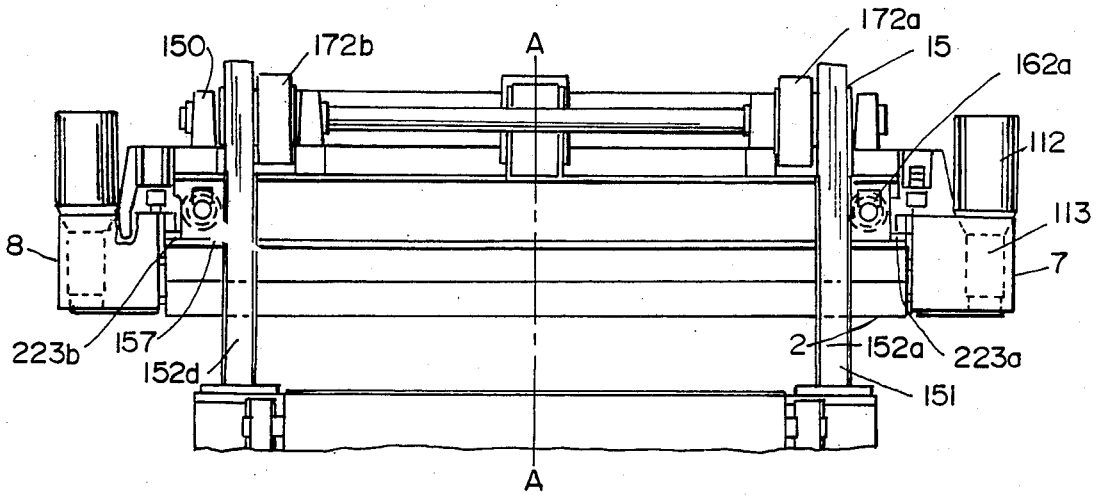
FIG. 4 is a detailed drawing of the apparatus as shown in FIG. 2.

In the preferred embodiment depicted in FIGS. 1–5, platen assembly 15 includes platform 150 mounted on a support framework 151 adapted for raising and lowering platform 150 so as to break and make contact between T-bar assembly 4, roller assembly 4, and stack 19. Support framework 151 includes a plurality of vertical posts or stanchions such as left front stanchion 152 (*a*), and right front stanchion 152 (*b*), (FIGS. 1, 3), right rear stanchion 152 (*c*). (FIG. 5), and left rear stanchion 152 (*d*) (FIGS. 2, 4). Stanchions 152 (*a*), (*b*), (*c*) and (*d*) are positioned relative to each other so as to form a right rectangle and are attached directly or indirectly at their lower ends by conventional means such as bolts to a table, floor or some other structure which is relatively stable and capable of physically supporting the apparatus. Inward faces 153 (*a*) and 153 (*b*) of left front stanchion 152 (*a*) and right front stanchion 152 (*b*), respectively, and inward faces 153 (*c*) and 153 (*d*) of right rear stanchion and left rear stanchion, respectively, have attached thereto vertical gear racks 154 (*a*), (*b*), (*c*), (*d*), respectively, having horizontally oriented gear teeth 155 as shown in FIGS. 13 and 14. Stanchions 152 (*a*), (*b*), (*c*) and (*d*) are connected at their upper ends by front, right, rear and left transverse stabilizer rails 156 (*a*), (*b*), (*c*) and (*d*), respectively, which are attached to the sides of stanchions 152 (*a*) (*b*), 152 (*b*) (*c*), 152 (*c*) (*d*) and 152 (*d*) (*a*), respectively, near the stanchion tops by a plurality of bolts.

Figure 17:
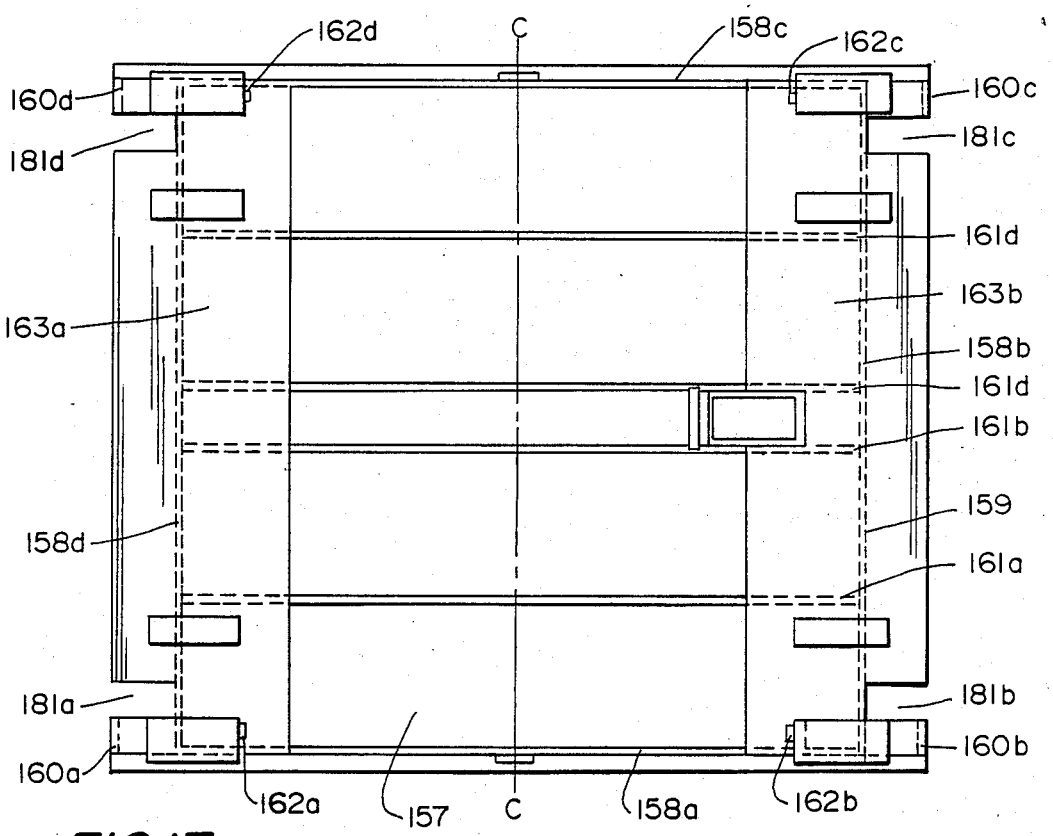
FIG. 17 is a top view of structural members of the platform of FIGS. 1–5, taken from the top of FIG. 3.
Figure 18:
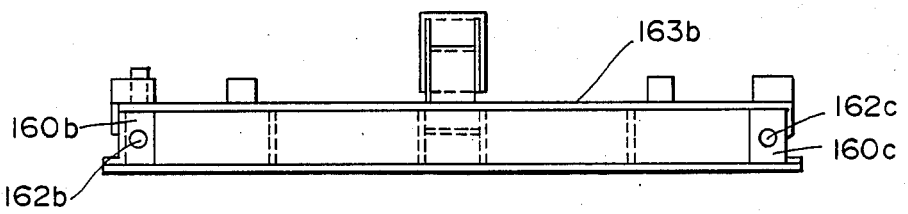
FIG. 18 is a side view, taken from the right, of the partial platform of FIG. 17.
Figure 19:
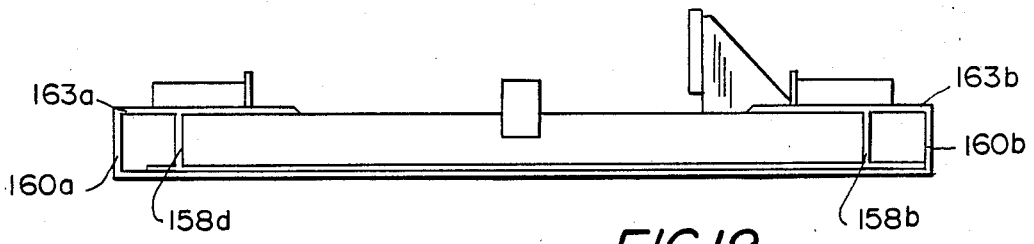
FIG. 19 is an end view, taken from the front, of the partial platform of FIG. 17.

Referring to FIG. 17, platform 150 includes a flat, one-piece bottom plate 157. Bottom plate 157 is slightly wider and longer than the outside of the rectangle defined by stanchions 152 (*a–d*), and is cut away at 181 (*a*) (*b*) (*c*) (*d*) to permit bottom plate 157 to be inserted between stanchions 152 (*a–d*) and vertical gear racks 154 (*a*) (*b*) (*c*) (*d*). The length of bottom plate 157 will be dicated by the assembled length of roller assembly 4, including drive unit 7 and idle unit 12 with which bottom plate 157 directly and indirectly is attached. Bottom plate 157 is formed from a relatively thick, durable metal, such as ¾ inch steel.

Four frame plates, front, right, rear and left frame plates 158 (*a*) (*b*) (*c*) (*d*), are attached on one long side edge to platform bottom plate 157, slightly inward from the edge, and are attached to each other at their ends to form an upstanding rectangular frame 159 by conventional means such as welding. A plurality of internal upstanding ribs 161 (*a–d*) are oriented within upstanding rectangular frame 159 parallel to front and rear frame plates 158 (*b*) (*d*) and are attached to bottom plate 157 and frame plate 158 (*b*) (*d*) by conventional means such as welding. A relatively short, upstanding pin support plate 160 (*a*) (*d*) and 160 (*b*) (*c*) is weld to bottom plate 157 and left and right equipment decks 163 (*a*) (*b*), respectively, so that 160 (*a*) (*d*) are left of left front and rear stanchions 152 (*a*) (*d*), respectively, and 160 (*b*) (*c*) are right of stanchions 152 (*b*) (*c*), respectively. The front ends of left and right pin support plates 160 (*a*) (*b*) are approximately even with front frame plate 158 (*a*), and the rear ends of left and right pin support plates are approximately even with rear frame plate 158 (*c*). Rollers 162 (*a*) (*d*) are pinned between left front and left rear pin support plates 160 (*a*) (*d*), respectively, and left frame plate 158 (*d*) so as to be in rolling contact with the sides of front and rear left stanchions 152 (*a*) (*d*), respectively, and thereby stabilize the position of platform 150 as it is being raised and lowered. Similarly, rollers 162 (*b*) (*c*) are pinned between right front and rear pin support plates 160 (*b*) (*c*), respectively, and are in rolling contact with right front and rear stanchions 152 (*b*) (*c*), respectively.

Left and right equipment mounting decks 163 (*a*), (*b*) are positioned on top along the left and right sides of frame 159 and are attached to internal ribs 161 (*a–d*) as well as frame 159 by conventional means such as welding. Referring to FIG. 5, a plurality of paired pillow blocks are attached to the partial platforms through housing support blocks by conventional means such as welding. In the preferred embodiment depicted in FIG. 5, two pair of pillow blocks, right front pillow blocks 164 (*c*) (*d*) and right rear pillow blocks 164 (*e*) (*f*) are affixed to right partial platform 163 (*b*) such that right front pillow blocks 164 (*c*) (*d*) are front and rear respectively and generally to the left of right front stanchion 152 (*b*), and right rear pillow blocks 164 (*e*) (*f*) are front and rear, respectively, and generally to the left of right rear stanchion 152 (*c*). Left front pillow blocks 164 (*a*) (*b*) and left rear pillow blocks 164 (*g*) (*h*) are affixed to left partial platform 163 (*a*) generally to the right and to the front and rear respectively, of left front stanchion 152 (*a*) and the front and rear of left rear stanchion 152 (*d*). Further, left front pillow blocks 164 (*a*) (*b*) are affixed to left partial platform 163 (*a*) so as to be generally opposite right front pillow blocks 164 (*c*) (*d*) and left rear pillow blocks 164 (*g*) (*h*) are affixed to left partial platform 163 (*a*) so as to be generally opposite right rear pillow blocks 164 (*e*) (*f*).

Figure 21:
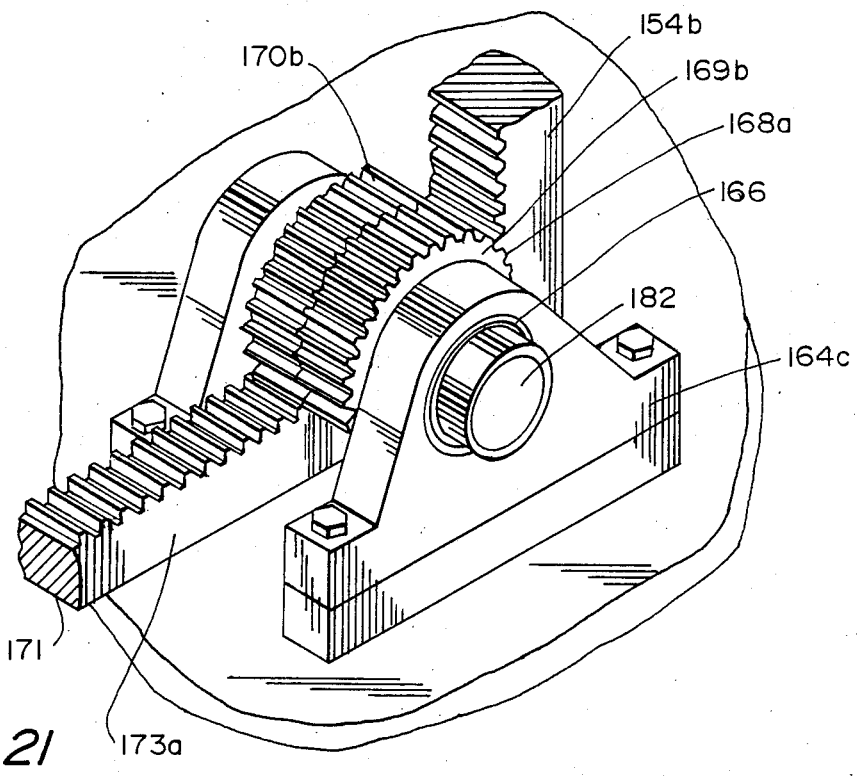
FIG. 21 is a partial perspective view of the right front underhand rack, vertical lift gear, horizontal slide gear, pillow block and vertical gear rack of FIG. 5.

Referring to FIG. 5, left gear shaft 165 (*a*) and right gear shaft 165 (*b*) extend through apertures in pillow blocks 164 (*a*), (*b*), (*g*), (*h*) and 164 (*c*), (*d*), respectively. Bearings such as 166 positioned within the retaining collars such as 164 (*c*) in FIGS. 3 and 21 are in contact with the gear shafts, such as 165 (*b*), and facilitate shaft rotation. A retaining collar, such as 182 in FIGS. 3, 5 and 21, fits onto the end of the gear shaft 165 (*b*) and keeps the gear shaft from shifting lengthwise in the pillow block.

Figure 20:
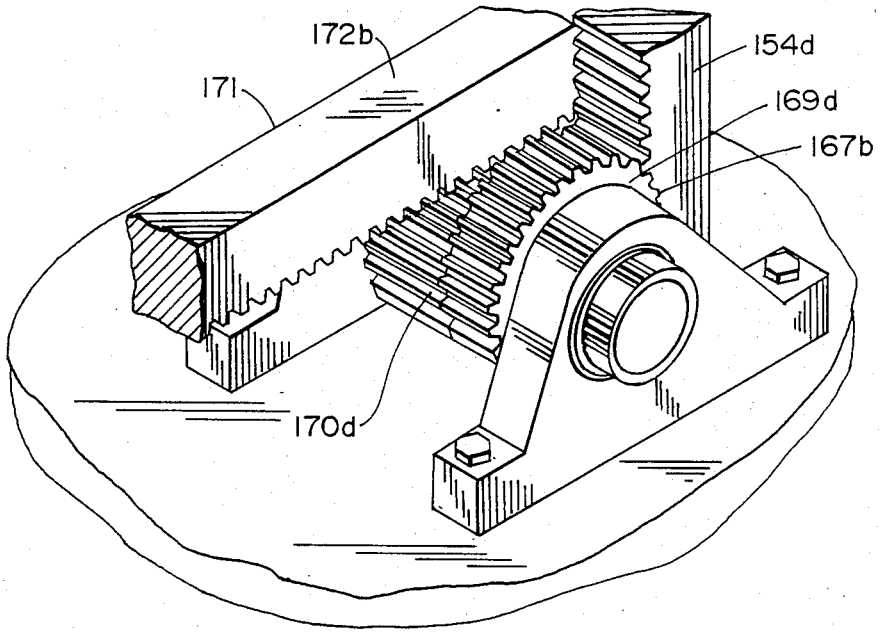
FIG. 20 is a partial perspective view of the left rear overhand rack, vertical lift gear, horizontal slide gear, pillow block and vertical gear rack of FIG. 5.

Fitted concentrically on said left and right gear shafts 165 (*a*), (*b*), and in a fixed relationship to the ends of shafts 165 (*a*) (*b*), and between each pair of retaining collars is a pair of gears, such as left rear overhand gear pair 167 (*b*) shown in FIG. 20 and right front underhand gear pair 168 (*a*) shown in FIG. 21. Each pair of gears includes a vertical lift gear such as 169 (*d*) and 169 (*b*), shown in FIGS. 20 and 21, respectively, which have gear teeth in contact with matching gear teeth on vertical rack 154 (*d*) and 154 (*b*), respectively. Rotation of gear shafts 165 (*a*) and 165 (*b*) causes vertical lift gears 169 (*a*), (*d*) and 169 (*b*), (*c*), (FIG. 5) respectively, to rotate and thereby move up or down vertical gear racks 154 (*a*) (*d*) and 154 (*b*) (*c*), respectively, by means of interlocking gear teeth on the vertical lift gears and vertical racks, thereby raising and lowering platform 150.

Each pair of gears also includes a horizontal slide gear, such as left rear horizontal slide gear 170 (*d*) and right front horizontal slide 170 (*b*) in FIG. 20, 21, respectively. Horizontal slide gears 170 (*a*), (*b*), (*c*), (*d*) (FIG. 5) have gear teeth which are in contact with matching gear teeth on horizontal rack 171.

Horizontal rack 171 includes an overhand rack portion having gear teeth on its underside, and an underhand rack portion having gear teeth on its upper side as shown, for example, at 172 (*b*) and 173 (*a*), respectively, in FIGS. 20 and 21.

Referring to FIG. 3, front overhand rack portion 172 (*a*) and front underhand rack portion 173 (*a*) are relatively narrow, elongate pieces which extend horizontally from left front horizontal slide gear 170 (*a*) and right front horizontal slide gear 170 (*b*), respectively, toward each other, and are joined by means of bolts to opposite horizontal faces of front connecting block 174 (*a*). Similarly, rear overhand rack portion 172 (*b*) and rear underhand rack portion 173 (*b*) extend horizontally toward each other from left rear horizontal slide gear 170 (*d*) and right rear horizontal slide gear 170 (*c*), respectively, and are joined by bolts on opposite horizontal face of rear connecting block 174 (*b*), (FIG. 5). The dimensions of front overhand and underhand rack portions 172 (*a*) and 173 (*a*) and front connecting block 174 (*a*) are such that overhand and underhand gear teeth may simultaneously engage the matching gear teeth on left front horizontal slide gear 170 (*a*) and right front horizontal slide gear 170 (*b*) respectively. Similarly, the dimensions of rear overhand and underhand rack portion 172 (*b*) and 173 (*b*) and rear connecting block 174 (*b*) are such that overhand and underhand gear teeth may simultaneously engage matching gear teeth on left and right horizontal slide gears 170 (*d*) and 170 (*c*).

Figure 22:
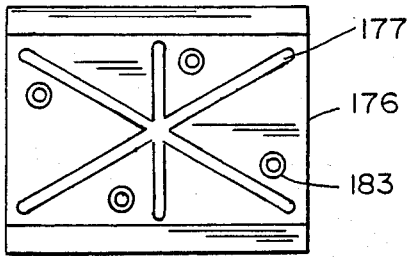
FIG. 22 is a bearing-side-up view of the bearing block useful in the present invention.

A slide block such as block 176 (FIG. 22) having upward facing bearings 177 is attached bearing face up by means of bolts through bolt hole 183 to the top of right equipment mounting deck 163 (*b*) underneath front and rear underhand racks and right front and rear slide gears 170 (*b*) (*c*) to facilitate sliding of underhand rack 173 (*a*) (*b*). A slide block such as 176 is also mounted bearing face up to front and rear partial equipment decks (not shown) mounted to front frame plate 158 (*a*) and internal rib 161 (*a*), and to rear frame plate 158 (*c*) and internal rib 161 (*d*) so as to be under and in sliding contact with the bottom of each of front and rear connecting blocks 174 (*a*) (*b*) to facilitate the sliding of the blocks during raising and lowering of platform 150.

Figure 23:
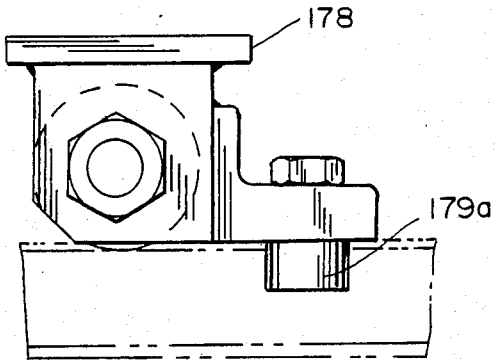
FIG. 23 is a side view of rack retainer 178 of FIG. 5, taken from the left of FIG. 5.
Figure 24:
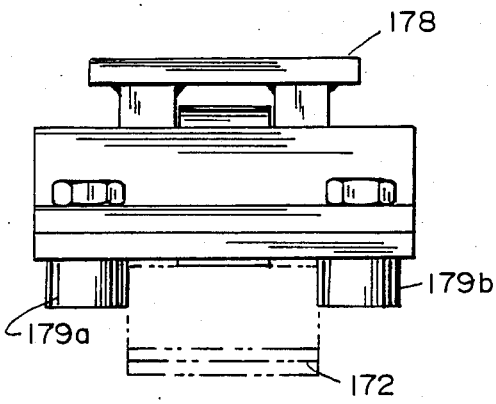
FIG. 24 is a front view of the rack retainer of FIG. 23, taken from the right of FIG. 23.

Referring to FIGS. 23, 24, rack retainer 178 holds down and guides overhand racks 172 (*a*) (*b*) by means of cam rollers which fit on either side of overhand racks in proximity to the point of contact between the overhand racks and the horizontal slide gears, and are in rolling contact with the sides of the overhand rack, such as shown at 179 (*a*) (*b*) FIGS. 23, 24. Rack retainer 178 is maintained in position by Y-rail 180 (FIG. 5) bolted to left equipment mounting deck 163 (*a*). A similar rack retainer may be used in conjunction with overhand rack 172 (*b*), as well as the one shown for rack 172 (*a*) in FIG. 5. However, if overhand racks are firmly attached to the connecting blocks, use of rack retainers is considered optional.

Referring to FIG. 5, the left sides of front and rear blocks 174 (*a*) (*b*) are connected by means of left side rail 175 (*a*) attached thereto, and right sides of front and rear connecting blocks 174 (*a*) (*b*) are connected by means of right side rail 175 (*b*) attached thereto by conventional means such as welding. Hydraulic cylinder 187 is also attached to peripheral hydraulic support equipment (not shown) apparent and known to those skilled in the art.

Referring to FIGS. 1 and 3, hydraulic system 185 is attached to platform 150 and imparts motion to slide gears and lift gears to raise and lower platform 150, as well as applying positive pressure to the stack in addition to the dead weight of platform 150, T-bar assembly 2 and roller assembly 4. Referring to FIG. 5, hydraulic system 185 includes interconnected hydraulic cylinder 187, rod 184, rod end 187, clevis 188 and pusher 189. Pusher 189 is attached to left and right side rails 175 (*a*) (*b*) by conventional means such as bolts. Hydraulic cylinder 187 is attached to cylinder mounting 200 which is welded to internal ribs 161 (*b*) (*c*). Hydraulic cylinder 187 is also attached to peripheral hydraulic support equipment (not shown) apparent and known to those skilled in the art.

Operation of hydraulic cylinder 186 results in extension and/or retraction of rod end 187, clevis 188 and pusher 189 and connecting blocks 174 (*a*) (*b*) to which pusher 189 is indirectly attached. This results in horizontal motion of overhand and underhand rack portion 172 (*a*), (*b*) and 173 (*a*), (*b*). This motion is communicated by means of interlocking gear teeth to turn horizontal slide gear 170 (*a*), (*d*), (*b*) and (*c*), respectively. This results in rotation of left and right shafts 165 (*a*), (*b*) and rotation of vertical lift gear 169 (*a*), (*d*) and 169 (*b*), (*c*) respectively, causing platform 150 to be raised or lowered.

Figure 25A:
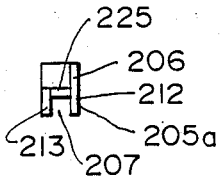
FIG. 25A is an end view, taken from the right, of upper guide track 208(*a*) of FIG. 3.
Figure 25B:
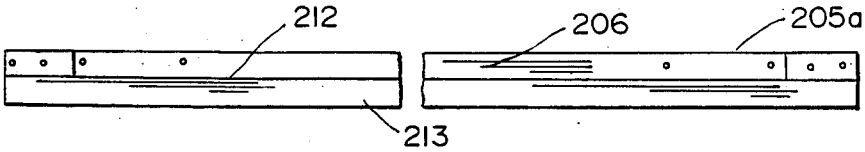
FIG. 25B is a front view of the upper guide track of FIG. 25A.

Referring to FIG. 3, front and rear upper guide tracks 205 (*a*) (*b*) are members which are as long as front and rear platform frame plates 158 (*a*), (*c*), respectively, and which are attached thereto by conventional means such as bolts through upper tab 206 (FIGS. 25A, B). Tracks 205 (*a*) (*b*), having the profile shown in FIG. 25A, wherein back rail 212 with upper tab 206 is connected to narrower front rail 213 by rib 225, so as to form an inverted U-shaped channel, such as 207, which is adapted to receive drive unit track guide rollers 107 (*a*) (*b*) and idle unit track guide rollers 142 (*a*) (*b*) and are fastened to front and rear frame plates 158 (*a*) (*b*) and are fastened to front and rear frame plates 158 (*a*) (*c*) so that drive and idle track rollers 107 (*a*) (*b*) and 142 (*a*) (*b*) rest in channel 207.

Front lateral rack 208 (*a*) is attached to front frame plate 158 (*a*) by means of left and right track mounting brackets 209 (*a*) (*b*), while rear rack 208 (*b*) is attached to rear frame plate 158 (*c*) by means of right and left mounting brackets 209 (*c*) (*d*). Mounting brackets 209 (*a*) (*b*) (*c*), (*d*) are angled brackets, such as shown in FIG. 27B with respect to bracket 209 (*b*), so that lateral rack spaced away from platform 150 to permit introduction of track 205 (*a*) and track guide rollers between lateral rack 208 (*a*) and platform 150. Mounting brackets bolt to the frame 159 through bolt holes such as 214 in FIG. 27A, and to the top ends of the lateral racks through bolt holes such as 221 in the bracket bottom plate such as 222 in FIG. 27A. The left side of front rack 208 (*a*) is similarly attached to the left side of front plate 158 (*a*) and rear lateral rack is similarly attached to rear frame plate 158 (*c*). Front and rear lateral racks 208 (*a*) (*b*) are approximately as long as front and rear frame plates 158 (*a*) (*b*), respectively, and have downward facing gear teeth on their bottom sides, such as shown with respect to front rack 208A in FIG. 26.

Front and rear guide tracks 223 (*a*) (*b*) for the upper platform guide rollers, such as 108 (*a*) (*b*) of drive unit 7 and 143 (*a*) (*b*) of idle unit 12, are formed by attaching a long, narrow strip to the top front and rear edges of bottom plate 157 between the edge and front frame plate 158 (*a*), and rear frame plate 158 (*c*) by conventional means such as welding or bolts (FIG. 4).

Left and right roller units 41 (*a*) (*b*) may be attached to electrical circuits by means known in the art in order to track their position along lateral rack 208 (*a*). Further electronic means which will be readily apparent to those skilled in the art may be used to coordinate operation of hydraulic system 185 with motion of roller 41 (*a*) (*b*).

As will be apparent to those skilled in the art, most of the components described above are most appropriately fabricated from steel, although other materials, such as rubber for seals, etc., may also be used.

In the preferred embodiment depicted in FIGS. 1 and 2, stanchions 152 (*a–d*) are attached to a table which includes coneyor means 215 which is capable of moving a stack horizontally so that the stack is directly beneath T-bar assembly 2 and roller assembly 4. Conveyor means 215 includes a two or three-ply plastic laminate belt 216. Left and right conveyor rollers 217 (*a*), (*b*) in FIG. 1 are positioned in contact with belt 216, and are in communication with a driving mechanism (motor 217, reducer 218 and chain 219) capable of imparting motion to conveyor drive roller 224 so as to rotate said roller and thereby impart motion to belt 216. The position of lower slack roller 220 is adjustable by conventional means so as to reduce slack in belt 216. Although the preferred embodiment depicts conveyor means 215 as being configured so that the stack 19 enters and leaves apparatus 1 along the sides, this is not critical to the invention, and may be readily altered by orienting the conveyor or the apparatus 90 or 180 degrees in any direction about axis A—A.

Figure 28:
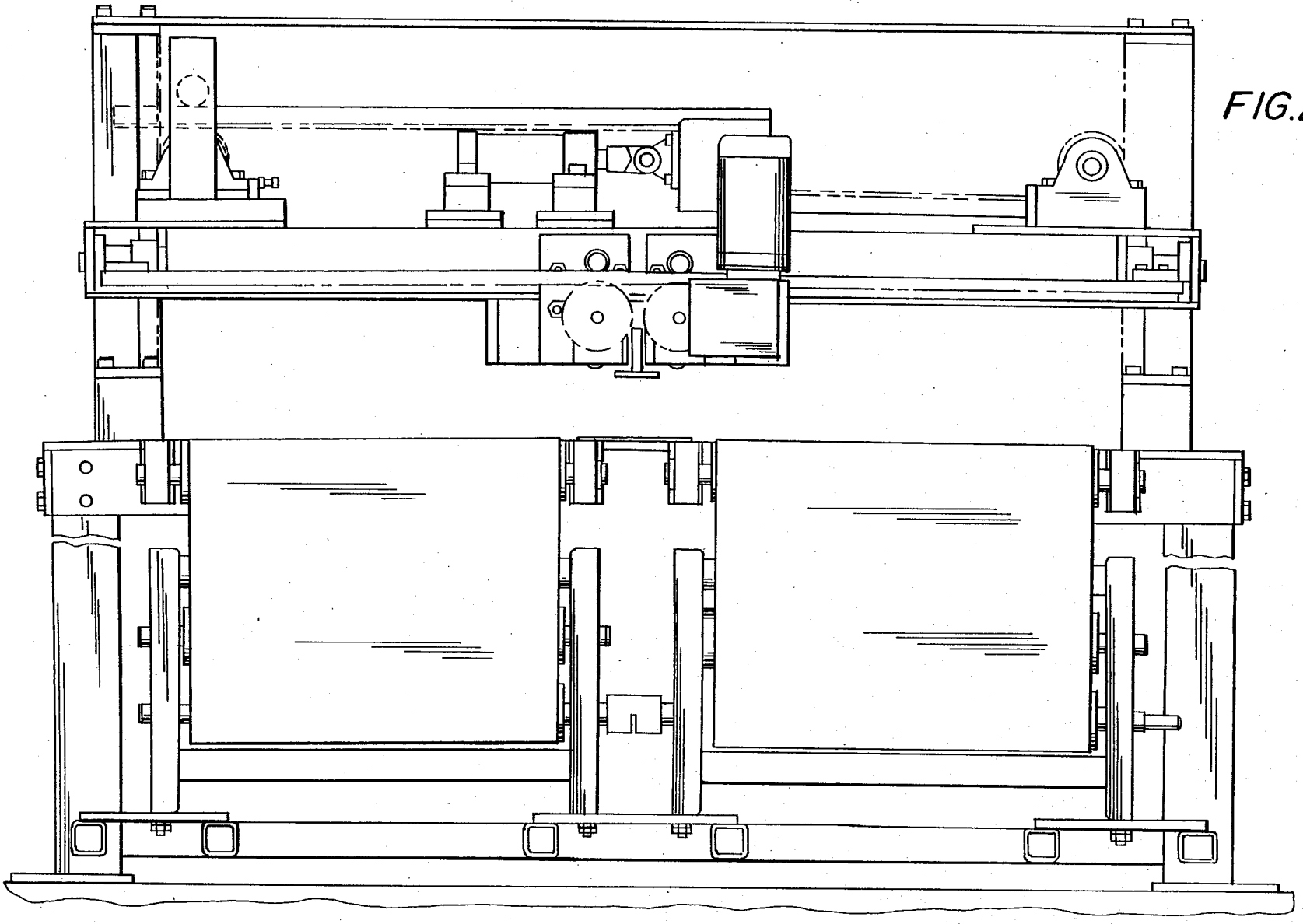
FIG. 28 is a front view of a less preferred embodiment of the invention and conveyor means.
Figure 29:
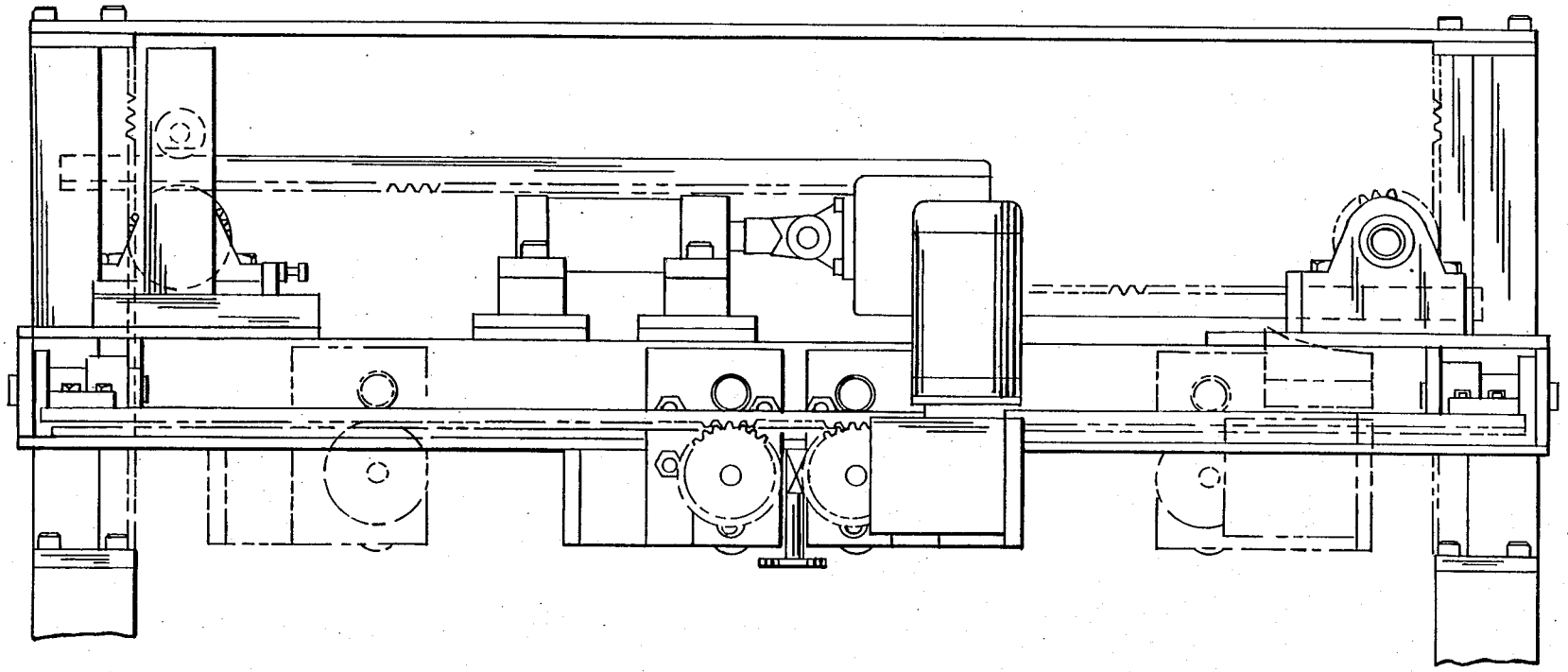
FIG. 29 is a more detailed front view, without conveyor means, of the embodiment of FIG. 28.
Figure 30:
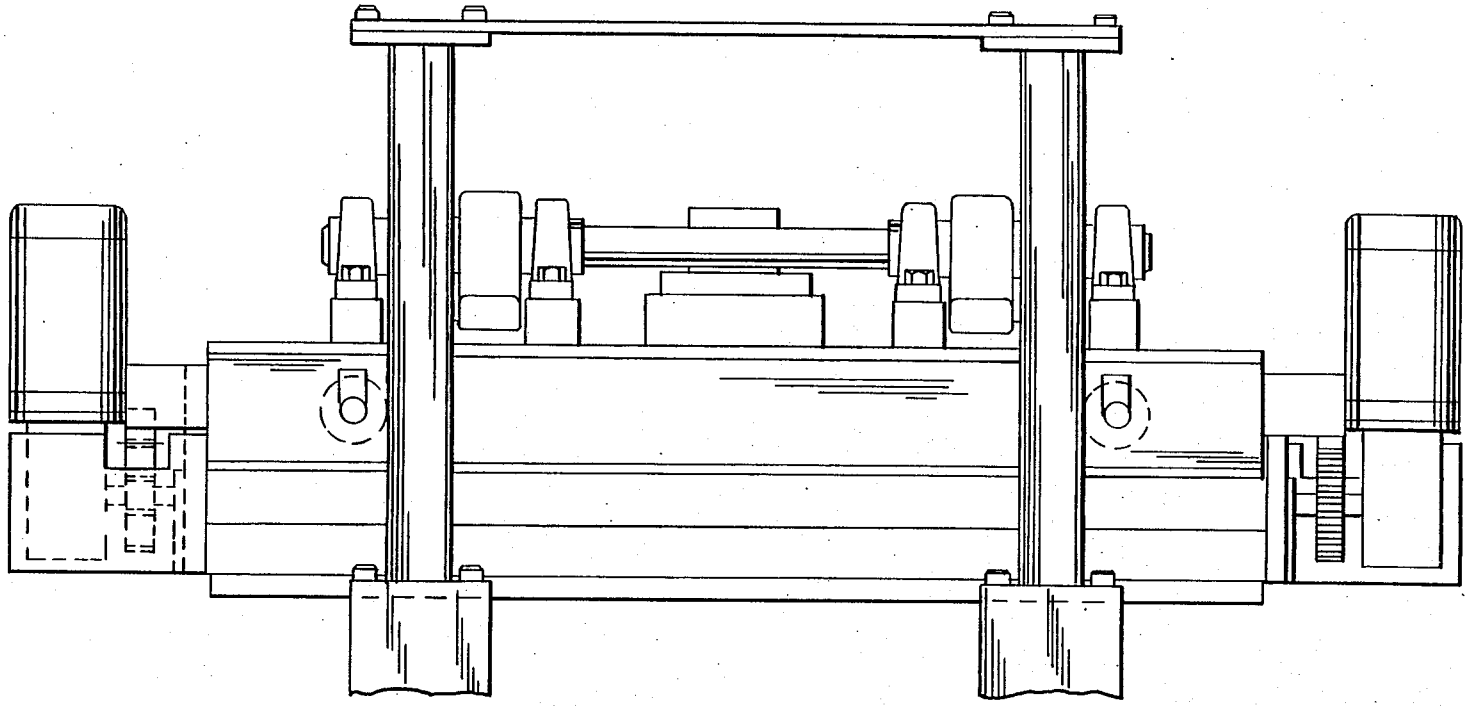
FIG. 30 is a side view, taken from the right, of the embodiment of FIG. 28.

Alternative embodiments, although less preferred than that discussed above, are depicted in FIGS. 28–30.

We claim:

1. An apparatus for removing fluid from overlapping sheets of material, said apparatus comprising an inverted T-bar means for applying stationary pressure to overlapping sheets disposed beneath said T-bar means, and at least two roller assembly means, said roller assembly means each including a lower pressure roller and an upper drive roller, said drive roller being in frictional contact with both said pressure roller and a superstrate positioned above said drive roller, at least one roller assembly means being positioned on each side of said T-bar means such that said pressure roller and said drive roller are substantially parallel thereto, and said roller assembly means being adapted to apply a moving pressure through said pressure rollers to overlapping sheets disposed beneath said roller assembly means.

2. The apparatus of claim 1 wherein said roller assembly means includes a drive gear attached to one end of said drive roller, said roller drive gear being meshed with both a drive gear connected to a rotary power source and matching gear teeth on a first horizontally oriented gear rack such that rotation of said power source drive gear causes said roller drive gear to rotate and said roller assembly to move horizontally along said rack.

3. The apparatus of claim 2 wherein the other end of said drive roller is attached to an idle gear, said idle gear being meshed with matching gear teeth on a second horizontally oriented gear rack such that rotation of said drive roller causes said idle gear to rotate and said roller assembly means to move horizontally along said rack.

4. The apparatus of claim 1 including a platen wherein said drive roller is in frictional contact with the underside of a platen.

5. The apparatus of claim 4 wherein said T-bar means is attached to the underside of said platen.

6. The apparatus of claim 5 wherein said T-bar means includes a steam and is attached to said platen through a plate which is substantially parallel to the stem of said inverted T-bar means and is in sliding contact therewith.

7. The apparatus of claim 6 wherein said inverted T-bar means is attached to said plate by means of a plurality of shoulder bolts inserted through holes in the stem of said T-bar means and attached to said plate.

8. The apparatus of claim 6 wherein said plate is attached at its upper end to a horizontally oriented bar, and said bar is attached to said platen.

9. The apparatus of claim 1, including a platen wherein said platen includes a substantially planar bottom plate disposed above and in frictional contact with said drive roller.

10. The apparatus of claim 9 wherein said drive roller and said pressure roller are attached in rolling contact on each end with an end plate, said end plate having affixed thereto a plurality of cam follower means, at least one cam follower means being adapted to hold down said lateral rack.

11. The apparatus of claim 10 wherein at least one of said cam follower means into a guide track attached to said platen.

12. The apparatus of claim 1 wherein said inverted T-bar means includes a stem and has attached to the top of said stem a plurality of posts adapted for receiving coiled springs.

13. The apparatus of claim 12 wherein a plurality of stops are attached to the top of said stem, said stops being longer than said posts.

* * * * *